US010527297B2

(12) United States Patent
Madigan et al.

(10) Patent No.: US 10,527,297 B2
(45) Date of Patent: Jan. 7, 2020

(54) DOMESTIC HOT WATER INSTALLATION

(71) Applicant: Systemlink Aquaeco Limited, Tallaght, Dublin (IE)

(72) Inventors: Terrance William Madigan, Rathgar (IE); Terence Gerard Madigan, Rathgar (IE)

(73) Assignee: Systemlink Aquaeco Limited, Dublin (IE)

( * ) Notice: Subject to any disclaimer, the term of this patent is extended or adjusted under 35 U.S.C. 154(b) by 258 days.

(21) Appl. No.: 15/101,691

(22) PCT Filed: Dec. 5, 2014

(86) PCT No.: PCT/EP2014/076780
§ 371 (c)(1),
(2) Date: Jun. 3, 2016

(87) PCT Pub. No.: WO2015/082708
PCT Pub. Date: Jun. 11, 2015

(65) Prior Publication Data

US 2016/0305671 A1 Oct. 20, 2016

(30) Foreign Application Priority Data

Dec. 5, 2013 (GB) ..... 1321516.5

(51) Int. Cl.
*F24D 19/10* (2006.01)
*F24D 17/00* (2006.01)

(52) U.S. Cl.
CPC ..... *F24D 19/1081* (2013.01); *F24D 17/0031* (2013.01); *F24D 19/1063* (2013.01);
(Continued)

(58) Field of Classification Search
None
See application file for complete search history.

(56) References Cited

U.S. PATENT DOCUMENTS 759,380 A * 5/1904 Kane ..... F24H 9/124 126/362.1
1,269,053 A * 6/1918 Clark et al. ..... F24H 1/20 122/18.5

(Continued)

*Primary Examiner* — Thor S Campbell
(74) *Attorney, Agent, or Firm* — Brian J. Colandreo; Michael T. Abramson; Holland & Knight LLP

(57) ABSTRACT

This invention relates to a domestic hot water installation (1, 51, 61, 71) comprising a hot water cylinder (3), an external heating circuit (4) such as a boiler (5) in combination with a heat exchanger (7), a pump (9), and a control circuit (11). The control circuit comprises a pair of sensors (15, 17), at least one of which is a temperature sensor, and a programmable controller (13) in communication with the sensors. The programmable controller has a processor (19), an accessible memory (21), and means (23) to operate the pump. The programmable controller monitors the data from the sensors and accurately calculates the amount of hot water that has been delivered to the hot water cylinder. When the correct amount of water, according to a domestic hot water profile, has been delivered to the hot water cylinder, the programmable controller stops hot water from being delivered into the tank by shutting off the pump. By providing such an installation, the amount of hot water delivered can be accurately controlled and waste of energy is minimized.

5 Claims, 2 Drawing Sheets

(52) U.S. Cl.
CPC .... *F24D 2200/08* (2013.01); *F24D 2220/042* (2013.01); *F24D 2220/044* (2013.01)

(56) References Cited

U.S. PATENT DOCUMENTS 3,608,818 A * 9/1971 Von Fellenberg ..... F24D 3/02 165/279
4,623,093 A * 11/1986 Arndt ..... F24H 9/124 237/19
5,006,689 A * 4/1991 Kurachi ..... F24H 1/142 122/13.01
5,067,170 A * 11/1991 Nagashima ..... F24H 9/2021 392/339
5,143,049 A * 9/1992 Laing ..... F04D 13/16 122/13.3
5,956,462 A * 9/1999 Langford ..... F24H 9/2021 307/38
7,021,073 B2 * 4/2006 Sakakibara ..... F24D 19/1054 165/240
7,856,835 B2 * 12/2010 Ida ..... F24D 3/18 62/150
8,117,998 B2 * 2/2012 Kim ..... F24D 19/1006 122/406.1
8,191,513 B2 * 6/2012 Krause ..... F24D 17/0078 122/20 R
8,285,129 B2 * 10/2012 Kim ..... F24D 17/0031 392/449
8,304,700 B1 * 11/2012 Eilers ..... A47J 37/0694 219/454.11
8,978,744 B2 * 3/2015 Chikami ..... F24D 3/082 165/146
9,170,030 B2 * 10/2015 Nagata ..... F24D 3/082
9,341,390 B2 * 5/2016 van der Heijden ..... F24H 1/185
9,897,341 B2 * 2/2018 Suzuki ..... F24H 4/04
2005/0022542 A1 * 2/2005 Sakakibara ..... F24D 19/1054 62/183
2009/0113911 A1 * 5/2009 Nakayama ..... F24D 17/02 62/238.6
2009/0250203 A1 * 10/2009 Ida ..... F24D 3/18 165/287
2014/0144607 A1 * 5/2014 Furukawa ..... F28F 19/00 165/84

* cited by examiner

DOMESTIC HOT WATER INSTALLATION

CROSS-REFERENCE TO RELATED APPLICATIONS

The subject application is a U.S. National Stage application of International Application No. PCT/EP2014/076780, filed on Dec. 5, 2014, which claims the priority of Great Britain Patent Application No. 1321516.5, filed Dec. 5, 2013. The contents of both applications are herein incorporated by reference in their entirety.

TECHNICAL FIELD

This invention relates to a domestic hot water installation and a method of operating a domestic hot water installation.

BACKGROUND ART

Energy costs represent a significant portion of many household budgets. It is generally accepted that it is desirable to reduce the amount of energy being consumed in a household in order to reduce the household's total expenditure on energy costs. In many cases, a significant portion of these energy costs are directly attributable to energy used to heat water for a domestic hot water installation.

Domestic hot water installations comprise a hot water cylinder in which hot water is stored for subsequent use in the household, e.g. for baths, showers and also for supply to sinks and kitchen appliances. Typically, the hot water cylinder has a capacity for between 200 and 300 litres of water. More often than not, this far exceeds the amount of hot water required at a given point in time. For example, a 5 minute shower is estimated to require approximately 33 litres of hot water from the hot water cylinder. If the entire tank is heated for the purpose of an individual having a shower, which is not an entirely uncommon occurrence, then a significant amount of energy has been wasted heating the remaining water in the tank unnecessarily.

Various solutions have been proposed to address this problem. One common solution is to provide a timer clock on the immersion heater so that the immersion is programmed to operate for a predetermined period of time. Although this goes some way to addressing the problem of the entire hot water cylinder being heated unnecessarily, it is still not entirely satisfactory as it is a crude way of determining how much hot water will be available for use in the household. The homeowner will effectively have to guess the length of time that it is necessary to power the immersion and will use trial and error in order to ensure that a sufficient amount of hot water will be available for use in the household. This often results in excess hot water being made available and a waste in energy. Furthermore, these systems are not suitable for domestic hot water installations that operate using an external water heating circuit such as a boiler or an external electrical water heater rather than an immersion heater.

Another solution that has been proposed that is more suited to hot water installations that are not immersion based but instead are boiler based, is to provide a large number of temperature sensors connected to the exterior of a hot water cylinder. The temperature sensors are connected at discrete locations spaced apart from each other and are used to measure the temperature at each of the discrete locations. In this way, it is possible to measure with a reasonable degree of accuracy the volume of hot water in the hot water cylinder at any given time. However, the sensors are relatively expensive and increase the overall cost of the cylinder significantly. This has resulted in a cylinder that is not price competitive and unpopular in the market place.

It is an object of the present invention to provide a hot water installation and a method of operating a hot water installation that overcomes at least some of these problems and offers a useful choice to the consumer.

SUMMARY OF INVENTION

According to the invention there is provided a domestic hot water installation comprising:

- a hot water cylinder;
- an external heating circuit coupled to the hot water cylinder, the external heating circuit having an inlet fed from the hot water cylinder through which water to be heated is delivered to the external heating circuit and an outlet through which heated water that has passed through the external heating circuit is returned to the hot water cylinder;
- a pump for circulating water from the hot water cylinder, through the external heating circuit and back to the hot water cylinder; and
- a control circuit for controlling the amount of hot water that is in the hot water cylinder, the control circuit comprising:
  - a first sensor operable to measure the temperature of hot water being delivered into the hot water cylinder;
  - a second sensor operable to measure a characteristic of the water being delivered into the hot water cylinder for use in the determination of the amount of hot water being delivered into the hot water cylinder; and
  - a programmable controller in communication with the first and second sensors, the programmable controller having: a processor for processing the data received from the first and second sensors; an accessible memory for storage of a domestic hot water profile; and means to operate the pump in accordance with the domestic hot water profile.

By having such a hot water installation, there will be far greater control over the amount of hot water that is made available in the hot water cylinder. The installation will closely monitor, to a high degree of accuracy, the amount of hot water in the hot water cylinder and will be able to ensure that the correct amount of hot water is available when required. Energy will not be wasted needlessly providing surplus hot water. Furthermore, the solution proposed is seen as particularly useful as it does not require a large number of sensors and therefore the cylinder will be priced at a competitive rate.

In one embodiment of the invention there is provided a domestic hot water installation in which the second sensor is a flow sensor. This is seen as a particularly suitable solution in that the flow sensor will be able to measure accurately the volume of hot water that is being delivered into the hot water cylinder and it will be a simple way of determining how much hot water will be available for use in the tank.

In one embodiment of the invention there is provided a domestic hot water installation in which the first sensor and the second sensor are housed in a single unit.

In one embodiment of the invention there is provided a domestic hot water installation in which the flow sensor is mounted in a return pipe connecting the outlet of the external heating circuit and an inlet of the hot water cylinder. This is a particularly simple way of providing the invention and will allow a simple retrofit of the monitoring apparatus to an existing domestic hot water installation.

In one embodiment of the invention there is provided a domestic hot water installation in which the means to operate the pump, in addition to turning the pump on and off, further comprises means to vary the speed of the pump. By altering the speed of the pump, it is possible to ensure that the water that is passed to the external heating circuit will be heated to a desired temperature before being delivered to the hot water cylinder.

In one embodiment of the invention there is provided a domestic hot water installation in which the second sensor is a temperature sensor operable to measure the temperature of the hot water that has been delivered into the hot water cylinder and in which the second sensor is located a fixed distance spaced apart from and below the first sensor. This is seen as a useful alternative to providing a flow sensor that will also allow the amount of hot water in the hot water cylinder to be determined with relative ease. If the distance between the two sensors is known and the dimensions of the hot water cylinder are known, it will be possible to determine the volume of water between the two temperature sensors. It will also be possible to monitor how long it takes to heat the volume of water between the two sensors up to the desired temperature. From this, it will be possible to extrapolate how long hot water will have to be provided to the hot water cylinder to provide the desired volume of hot water required by the household to an accurate degree. This is achieved simply with two reliable temperature sensors and will be cheaper to provide than known solutions.

In one embodiment of the invention there is provided a domestic hot water installation in which the second sensor is located internal the hot water cylinder. By placing the temperature sensor inside the hot water cylinder, although the environment is more hostile for the sensor, the degree of accuracy of the measurement will be improved resulting in a more efficient installation.

In one embodiment of the invention there is provided a domestic hot water installation in which the first sensor is located internal the hot water cylinder above and spaced apart from the second temperature sensor.

In one embodiment of the invention there is provided a domestic hot water installation in which the first sensor and second sensor are located in a portion of the hot water cylinder having a uniform cross section. By providing the sensors in such a location, it will be far simpler to retrofit the device and ensure that the volume of water between the two sensors is known with a high degree of accuracy.

In one embodiment of the invention there is provided a domestic hot water installation in which there is provided a third sensor, the third sensor is a temperature sensor operable to measure the temperature of the hot water that has been delivered into the hot water cylinder and in which the third sensor is located a fixed distance spaced apart from and below the second sensor. A third sensor will provide a degree of redundancy and improve the accuracy of the installation.

In one embodiment of the invention there is provided a domestic hot water installation in which the third sensor is located internal the hot water cylinder.

In one embodiment of the invention there is provided a domestic hot water installation in which the first sensor, the second sensor and the third sensor are all located in a portion of the hot water cylinder having a uniform cross section.

In one embodiment of the invention there is provided a domestic hot water installation in which the external heating circuit comprises:

a boiler; and a heat exchanger having a primary side coupled to the boiler and a secondary side coupled to the hot water cylinder, the primary side having an inlet fed from the boiler through which heating fluid is delivered from the boiler to the heat exchanger and an outlet through which heating fluid that has passed through the primary side of the heat exchanger is returned to the boiler, the secondary side having an inlet fed from the hot water cylinder through which water to be heated is delivered to the heat exchanger and an outlet through which heated water that has passed through the secondary side of the heat exchanger is returned to the hot water cylinder.

In one embodiment of the invention there is provided a domestic hot water installation in which the external heating circuit comprises an electrical heater, the electrical heater comprising a casing housing an electrical element, an inlet formed in the casing fed from the hot water cylinder through which water to be heated is delivered to the interior of the casing adjacent the electrical element and an outlet formed in the casing through which heated water that has been heated by the electrical element is returned to the hot water cylinder.

In one embodiment of the invention there is provided a method of operating a domestic hot water installation of the type comprising a hot water cylinder; an external heating circuit; a pump; and a control circuit, the control circuit comprising a first temperature sensor operable to measure the temperature of hot water being delivered into the hot water cylinder; a second sensor operable to determine the amount of hot water being delivered into the hot water cylinder; and a programmable controller in communication with the first and second sensors, the programmable controller having: a processor for processing the data received from the first and second sensors, an accessible memory for storage of a domestic hot water profile, and means to operate the pump in accordance with the domestic hot water profile; the method comprising the steps of:

monitoring the temperature of the hot water being delivered into the hot water cylinder;

monitoring the amount of hot water being delivered into the hot water cylinder;

the programmable controller calculating the amount of hot water in the hot water cylinder; and the programmable controller operating the pump in accordance with the domestic hot water profile including turning the pump on when the domestic hot water profile stipulates that more hot water than is currently present in the hot water cylinder is required in the hot water cylinder, and shutting the pump off when the domestic hot water profile stipulates that there is sufficient hot water in the hot water cylinder.

By having such a method, the method will ensure that the amount of hot water required in the household will be provided to a high degree of accuracy and the amount of energy needlessly wasted is reduced. Furthermore, this solution will operate using less sensors than would otherwise be required resulting in a more economic solution than was heretofore available.

In one embodiment of the invention there is provided a method of operating a domestic hot water installation in which the second sensor is a flow rate sensor mounted in a return line connecting an outlet of the external heating circuit to an inlet of the hot water cylinder, and in which the flow rate sensor records the amount of hot water being delivered through the return line into the hot water cylinder.

In one embodiment of the invention there is provided a method of operating a domestic hot water installation in which the step of the programmable controller operating the pump further comprises the programmable controller varying the speed of the pump.

In one embodiment of the invention there is provided a method of operating a domestic hot water installation in which the second sensor is also a temperature sensor and is located in the hot water cylinder a known distance below and spaced apart from the first temperature sensor, the method comprising the steps of:

measuring the time that elapses between the first temperature sensor recording an increase in temperature to a desired temperature and the second, lower temperature sensor in the hot water cylinder recording a corresponding increase in temperature; and the programmable controller using the measured elapsed time in the step of calculating the amount of hot water in the hot water cylinder.

In one embodiment of the invention there is provided a method of operating a domestic hot water installation comprising the initial step of inputting data regarding the spacing between the first temperature sensor and the second temperature sensor into the programmable controller.

In one embodiment of the invention there is provided a method of operating a domestic hot water installation comprising the initial step of inputting data regarding the dimensions of the hot water cylinder into the programmable controller.

BRIEF DESCRIPTION OF THE DRAWINGS

The invention will now be more clearly understood from the following description of some embodiments thereof given by way of example only with reference to the accompanying drawings, in which.

DETAILED DESCRIPTION OF THE DRAWINGS

Figure 1:
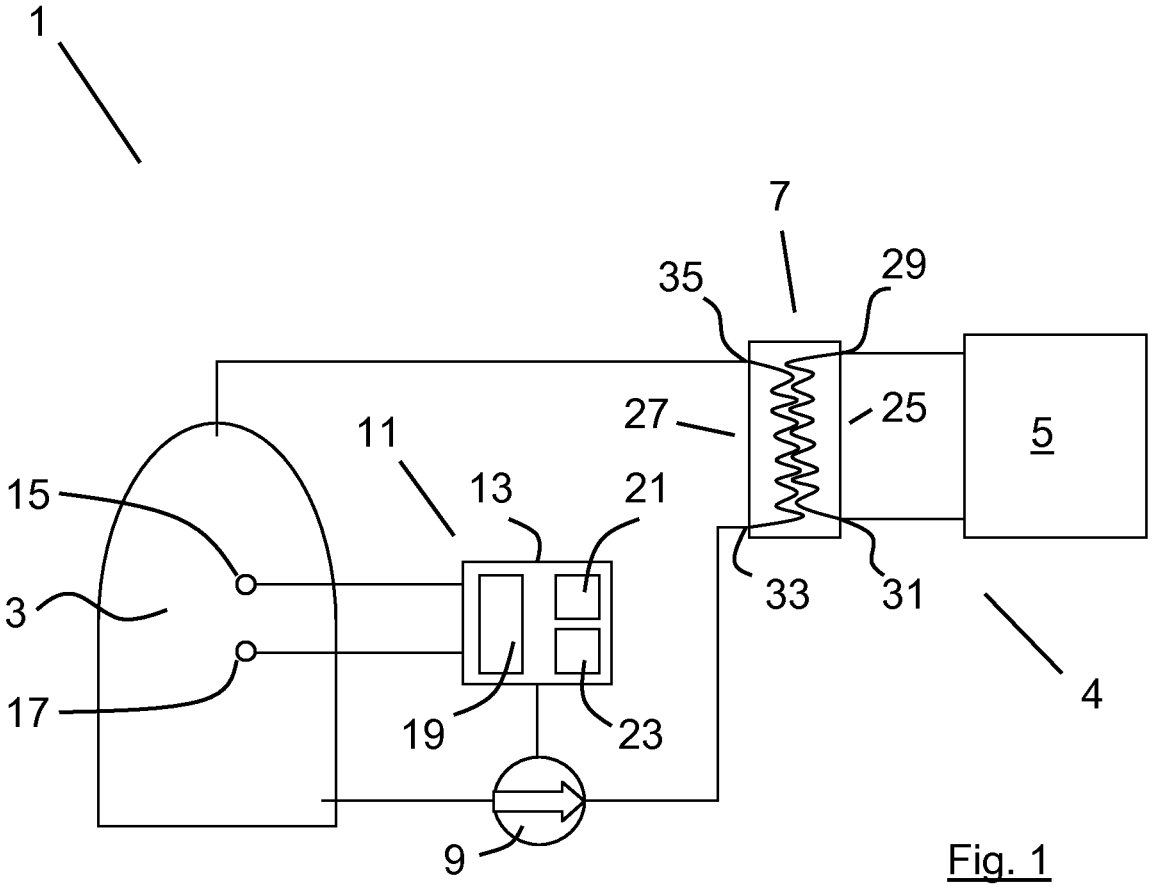
FIG. 1 is a diagrammatic representation of a domestic hot water installation according to the invention.

Referring to FIG. 1, there is shown a hot water installation, indicated generally by the reference numeral 1, comprising a hot water cylinder 3, an external heating circuit 4, a pump 9 and a control circuit 11. In the embodiment shown, the external heating circuit 4 in turn comprises a boiler 5 and a heat exchanger 7. The control circuit 11 comprises a programmable controller 13 and a pair of temperature sensors 15, 17 in communication with the controller 13. The pair of temperature sensors 15, 17 are located inside the hot water cylinder 3, vertically spaced apart from each other. The programmable controller 13 comprises a processor 19, an accessible memory 21, and means 23 to operate the pump 9.

The heat exchanger 7 has a primary side 25 coupled to the boiler 5 and a secondary side 27 coupled to the hot water cylinder 3. The primary side 25 has an inlet 29 fed from the boiler 5 through which heating fluid is delivered from the boiler to the heat exchanger 7 and an outlet 31 through which heating fluid that has passed through the primary side 25 of the heat exchanger 7 is returned to the boiler 5. The secondary side 27 of the heat exchanger 7 has an inlet 33 fed from the hot water cylinder 3, through which water to be heated is delivered to the heat exchanger 7, and an outlet 35 through which heated water that has passed through the secondary side 27 of the heat exchanger is returned to the hot water cylinder 3.

In use, the operator of the domestic hot water installation programs the programmable controller 13 with the hot water requirements of the household. This includes the amount of hot water required and when that hot water is required. The information is stored as a domestic hot water profile in accessible memory 21. The programmable controller 13 operates the pump 9 in accordance with the domestic hot water profile.

In order to allow the programmable controller 13 operate the pump in such a manner that it is able to ensure that the correct amount of hot water is available in the hot water cylinder, the programmable controller 13 will first of all have to be calibrated. The calibration of the controller 13 will comprise one or more of the following steps however it will be understood that there are alternative ways of calibrating the device and the following is provided as an example of one way of calibrating the device.

First of all, if the dimensions of the hot water cylinder are not already known to the programmable controller (for example if they have not been pre-programmed into accessible memory), the height and the diameter of the hot water cylinder are input by the operator into the programmable controller. If the total volume of the hot water cylinder is known, this may also be provided or alternatively, the processor 19 of the programmable controller 13 may calculate the volume of the entire hot water cylinder if accurate dimensions are provided. Thereafter, the distance between the two temperature sensors, again if not already known, is input into the programmable controller. Once the distance between the two sensors is known and the diameter of the cylinder is known, the programmable controller can determine, using the processor, the volume of water between the two sensors. Of course, it would be possible to simply provide this volume information directly to the programmable controller if it is already known or it could be pre-loaded in programmable controller memory if the sensors are pre-installed into the hot water cylinder. For retro-fit installations, at least some of this information will usually have to be provided to the programmable controller.

The programmable controller operates the pump 9 and hot water is then delivered to the hot water cylinder. As the cold water at the bottom of the hot water cylinder is drawn from the hot water cylinder, passed through the secondary side of the heat exchanger and delivered back to the top of the hot water cylinder, the cold water at the top of the hot water cylinder will be displaced with incoming hot water. After a period of time, the upper temperature sensor will detect the change in temperature of the water adjacent to the sensor and this information is provided to the programmable controller. It will be understood that in configurations such as that described, there is a high degree of stratification in the water and a low degree of mixing of the water in the hot water cylinder.

As the hot water continues to be delivered to the hot water cylinder, after a further period of time, the lower temperature sensor will detect a change in temperature of the water adjacent to the sensor and this information is passed to the programmable controller.

From the information provided by the upper and lower temperature sensors, it is possible to determine the length of time that it took to provide this fixed volume of hot water between the sensors and thereafter it is possible to determine the length of time it would take to provide any arbitrary amount of hot water in the hot water cylinder. Therefore, if the programmable controller is programmed with the amount of water required in the household at a given time, the programmable controller can operate the pump for a sufficient period of time to ensure that there is enough hot water in the hot water cylinder when required.

In addition to the foregoing, if the total volume of the hot water cylinder is known, the length of time that it would take to fill the entire hot water cylinder with hot water can be determined with relative ease. The programmable controller can then operate the pump to fill the entire tank with hot water from time to time. This may be of some use for legionella protection whereby the entire contents of the tank should be heated to of the order of 60° C. periodically, such as each week, to obviate the possibility of legionella contamination.

In addition to the above, it may be desirable for the sensors to also monitor the rate at which the water in the hot water cylinder cools down over time. This may be achieved by closely monitoring the temperature sensors and detecting the drop in temperature experienced by the sensors over time. This information will enable the system to avail of cheaper night time tariffs and ensure that there is enough hot water in the hot water cylinder taking into account a period of time that the water will have to cool down. If tariff data is provided to the programmable controller, the programmable controller can determine whether or not it is economical to avail of the cheaper tariffs at night time or whether the water will have cooled down too much by the time that it is required.

Figure 2:
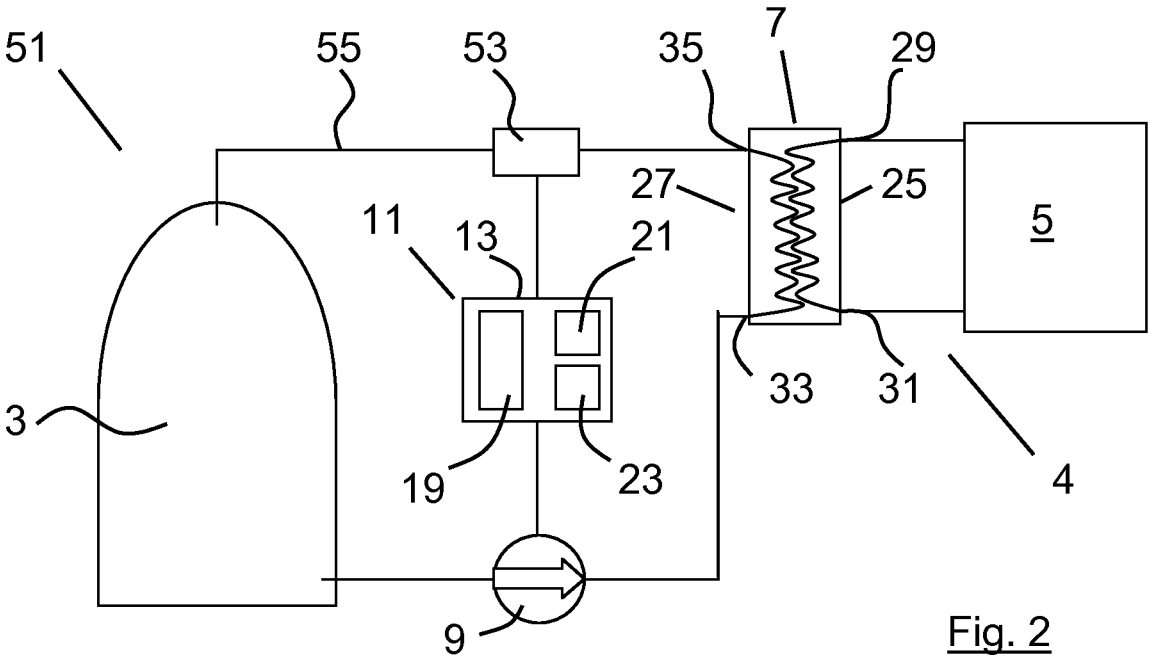
FIG. 2 is a diagrammatic representation of a second embodiment of domestic hot water installation according to the invention.

Referring to FIG. 2 of the drawings, there is shown an alternative embodiment of domestic hot water installation, indicated generally by the reference numeral 51, according to the invention where like parts have been given the same reference numerals as before. The domestic hot water installation 51 differs from the embodiment shown in FIG. 1 in that there is a combined temperature and flow sensor 53 mounted in the return line 55 between the outlet 35 of the secondary side 27 of the heat exchanger 7 and the inlet of the cylinder 3. The combined temperature and flow sensor monitors both the temperature of the hot water being delivered into the hot water cylinder and the amount of hot water being delivered into the hot water cylinder. The information is passed to the programmable controller 13. In this way, the programmable controller will know the amount of hot water that has been passed into the hot water cylinder with a high degree of accuracy.

In this embodiment, it is envisaged that it will also be preferable to allow the programmable controller to vary the speed of the pump 9 rather than simply turning the pump on or off. By allowing the programmable controller to vary the speed of the pump, if the temperature and flow sensor 53 should detect a decrease in the temperature of the hot water being delivered to the hot water cylinder, the pump speed may be decreased to ensure that the water remains in the heat exchanger for longer and is allowed to heat up to the desired temperature. For example, if there is a draw on the heating fluid delivered by the boiler, such as a draw of heating fluid to a heating installation in the household, the heating fluid delivered to the heat exchanger may be lower in temperature than if the boiler was only delivering heating fluid to the heat exchanger. In those cases, the hot water can be given more time to heat up in the heat exchanger by varying the speed of the pump. Alternatively, the delivery of heating fluid to the heat exchanger could be prioritised when the water is being heated up in such a system, or a valve could be provided to delay the delivery of hot water to the cylinder however the solution described is seen as preferable and advantageous.

As with the previous embodiment, this configuration will allow the programmable controller to determine, with a high degree of certainty, that the correct amount of hot water will be available for use in the hot water cylinder and the amount of waste will be reduced.

Figure 3:
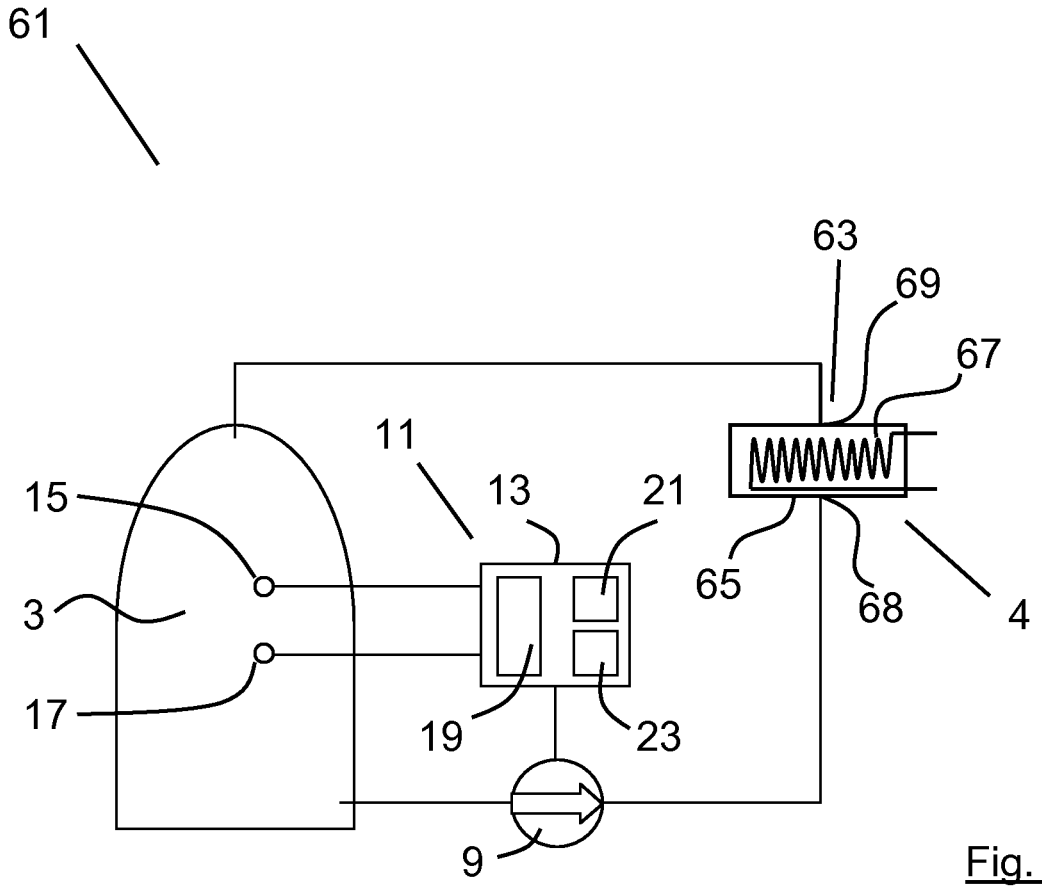
FIG. 3 is a diagrammatic representation of a third embodiment of domestic hot water installation according to the invention.
Figure 4:
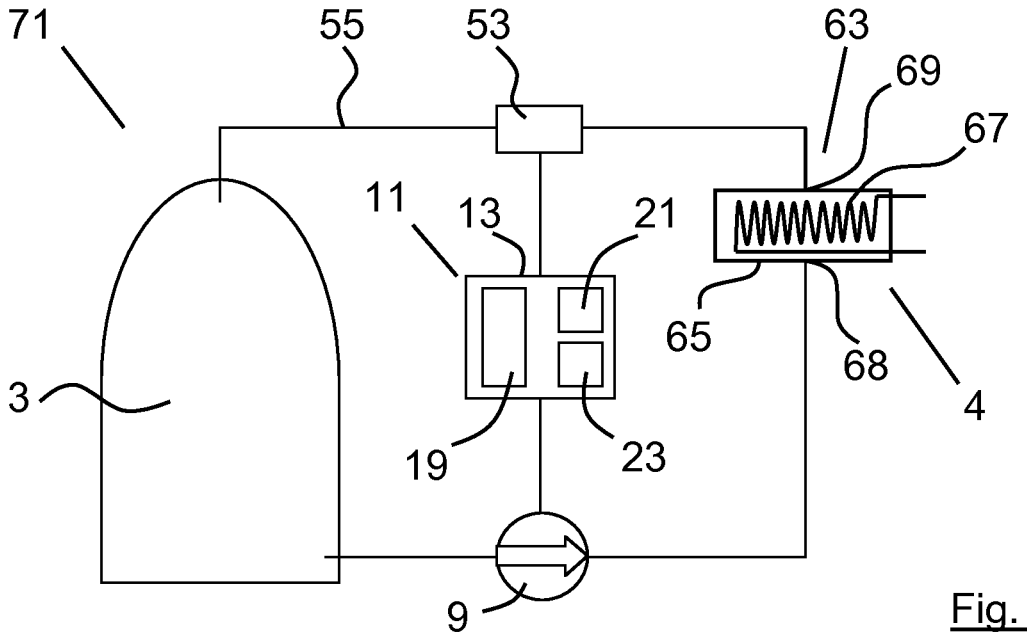
FIG. 4 is a diagrammatic representation of a fourth embodiment of domestic hot water installation according to the invention

Referring now to FIGS. 3 and 4, there are shown two further embodiments of domestic hot water installations, indicated generally by the reference numerals 61 and 71 respectively. The domestic hot water installation 61 is similar to the embodiment of domestic hot water installation shown in FIG. 1 and the domestic hot water installation 71 is similar to the embodiment of domestic hot water installation shown in FIG. 2. The domestic hot water installations 61 and 71 differ from the domestic hot water installations 1 and 51 respectively in that the external heating circuit 4 is provided by way of an electrical water heater unit 63 rather than by the boiler and heat exchanger configuration shown in FIGS. 1 and 2.

In the embodiments shown in FIGS. 3 and 4, the electrical water heater unit 63 is a Willis-type electrical heater comprising a casing 65 housing an electrical heating element 67 therein. A mains electrical power supply (not shown) is used to heat the electrical heating element 67. The casing 65 has an inlet 68 and an outlet 69. In use, cooler water is pumped from the hot water cylinder 3 using pump 9 through the inlet 68 and into the casing where the water is heated by the electrical heating element. This water passes through the casing 65 and out through the outlet 69 from where it is returned to the hot water cylinder 3 for subsequent use in the household. Although a Willis-type heater is described, different electrical water heater units could be used to good effect in place of the Willis-type heater.

Throughout the specification, reference is made to the control circuit and the programmable controller operating the pump to deliver the water from the cylinder to the external heating circuit. It will be understood that it may be preferable for the control circuit to also have the ability to control the external heating circuit. For example, the control circuit may cause the external heating circuit 4 such as a boiler to fire up and start providing heated fluid to the heat exchanger or may cause the electrical water heater unit to operate (effectively causing electricity to be supplied thereto) to heat water passing therethrough. This will particularly be the case in the embodiments using the electrical water heater unit.

In this specification the terms "comprise, comprises, comprised and comprising" and the terms "include, includes, included and including" are all deemed totally interchangeable and should be afforded the widest possible interpretation.

The invention is in no way limited to the embodiment hereinbefore described but may be varied in both construction and detail within the scope of the claims.

The invention claimed is:

1. A domestic hot water installation comprising:

a hot water cylinder;

an external heating circuit coupled to the hot water cylinder, the external heating circuit having an inlet fed from the hot water cylinder through which water to be heated is delivered to the external heating circuit and an outlet through which heated water that has passed through the external heating circuit is returned to the hot water cylinder;

a pump for circulating water from the hot water cylinder, through the external heating circuit and back to the hot water cylinder; and a control circuit for controlling the amount of hot water that is in the hot water cylinder, the control circuit comprising:

a first sensor operable to measure the temperature of hot water being delivered into the hot water cylinder;

a second sensor operable to measure a characteristic of the water being delivered into the hot water cylinder for use in the determination of the amount of hot water being delivered into the hot water cylinder; and a programmable controller in communication with the first and second sensors, the programmable controller having: a processor for processing the data received from the first and second sensors; an accessible memory for storage of a domestic hot water profile; and means to operate the pump in accordance with the domestic hot water profile;

in which the second sensor is a flow sensor; and in which the first sensor and the second sensor are housed in a single unit; and in which the external heating circuit comprises:

a boiler; and a heat exchanger having a primary side coupled to the boiler and a secondary side coupled to the hot water cylinder, the primary side having an inlet fed from the boiler through which heating fluid is delivered from the boiler to the heat exchanger and an outlet through which heating fluid that has passed through the primary side of the heat exchanger is returned to the boiler, the secondary side having an inlet fed from the hot water cylinder through which water to be heated is delivered to the heat exchanger and an outlet through which heated water that has passed through the secondary side of the heat exchanger is returned to the hot water cylinder.

2. A domestic hot water installation comprising:

a hot water cylinder;

an external heating circuit coupled to the hot water cylinder, the external heating circuit having an inlet fed from the hot water cylinder through which water to be heated is delivered to the external heating circuit and an outlet through which heated water that has passed through the external heating circuit is returned to the hot water cylinder;

a pump for circulating water from the hot water cylinder, through the external heating circuit and back to the hot water cylinder; and a control circuit for controlling the amount of hot water that is in the hot water cylinder, the control circuit comprising:

a first sensor operable to measure the temperature of hot water being delivered into the hot water cylinder;

a second sensor operable to measure a characteristic of the water being delivered into the hot water cylinder for use in the determination of the amount of hot water being delivered into the hot water cylinder; and a programmable controller in communication with the first and second sensors, the programmable controller having: a processor for processing the data received from the first and second sensors; an accessible memory for storage of a domestic hot water profile; and means to operate the pump in accordance with the domestic hot water profile;

in which the second sensor is a flow sensor; and in which the first sensor and the second sensor are housed in a single unit; and in which the flow sensor is mounted in a return pipe connecting the outlet of the external heating circuit and an inlet of the hot water cylinder; and in which the external heating circuit comprises:

a boiler; and a heat exchanger having a primary side coupled to the boiler and a secondary side coupled to the hot water cylinder, the primary side having an inlet fed from the boiler through which heating fluid is delivered from the boiler to the heat exchanger and an outlet through which heating fluid that has passed through the primary side of the heat exchanger is returned to the boiler, the secondary side having an inlet fed from the hot water cylinder through which water to be heated is delivered to the heat exchanger and an outlet through which heated water that has passed through the secondary side of the heat exchanger is returned to the hot water cylinder.

3. A domestic hot water installation comprising:

a hot water cylinder;

an external heating circuit coupled to the hot water cylinder, the external heating circuit having an inlet fed from the hot water cylinder through which water to be heated is delivered to the external heating circuit and an outlet through which heated water that has passed through the external heating circuit is returned to the hot water cylinder;

a pump for circulating water from the hot water cylinder, through the external heating circuit and back to the hot water cylinder; and a control circuit for controlling the amount of hot water that is in the hot water cylinder, the control circuit comprising:

a first sensor operable to measure the temperature of hot water being delivered into the hot water cylinder;

a second sensor operable to measure a characteristic of the water being delivered into the hot water cylinder for use in the determination of the amount of hot water being delivered into the hot water cylinder; and a programmable controller in communication with the first and second sensors, the programmable controller having: a processor for processing the data received from the first and second sensors; an accessible memory for storage of a domestic hot water profile; and means to operate the pump in accordance with the domestic hot water profile;

in which the second sensor is a flow sensor; and in which the first sensor and the second sensor are housed in a single unit; and in which the means to operate the pump, in addition to turning the pump on and off, further comprises means to vary the speed of the pump; and in which the external heating circuit comprises:

a boiler; and a heat exchanger having a primary side coupled to the boiler and a secondary side coupled to the hot water cylinder, the primary side having an inlet fed from the boiler through which heating fluid is delivered from the boiler to the heat exchanger and an outlet through which heating fluid that has passed through the primary side of the heat exchanger is returned to the boiler, the secondary side having an inlet fed from the hot water cylinder through which water to be heated is delivered to the heat exchanger and an outlet through which heated water that has passed through the secondary side of the heat exchanger is returned to the hot water cylinder.

4. A domestic hot water installation comprising:

a hot water cylinder;

an external heating circuit coupled to the hot water cylinder, the external heating circuit having an inlet fed from the hot water cylinder through which water to be heated is delivered to the external heating circuit and an outlet through which heated water that has passed through the external heating circuit is returned to the hot water cylinder;

a pump for circulating water from the hot water cylinder, through the external heating circuit and back to the hot water cylinder; and a control circuit for controlling the amount of hot water that is in the hot water cylinder, the control circuit comprising:

a first sensor operable to measure the temperature of hot water being delivered into the hot water cylinder;

a second sensor operable to measure a characteristic of the water being delivered into the hot water cylinder for use in the determination of the amount of hot water being delivered into the hot water cylinder; and a programmable controller in communication with the first and second sensors, the programmable controller having: a processor for processing the data received from the first and second sensors; an accessible memory for storage of a domestic hot water profile; and means to operate the pump in accordance with the domestic hot water profile;

in which the second sensor is a flow sensor; and in which the first sensor and the second sensor are housed in a single unit; and in which the external heating circuit comprises an electrical heater, the electrical heater comprising a casing housing an electrical element, an inlet formed in the casing fed from the hot water cylinder through which water to be heated is delivered to the interior of the casing adjacent the electrical element and an outlet formed in the casing through which heated water that has been heated by the electrical element is returned to the hot water cylinder.

5. A domestic hot water installation comprising:

a hot water cylinder;

an external heating circuit coupled to the hot water cylinder, the external heating circuit having an inlet fed from the hot water cylinder through which water to be heated is delivered to the external heating circuit and an outlet through which heated water that has passed through the external heating circuit is returned to the hot water cylinder;

a pump for circulating water from the hot water cylinder, through the external heating circuit and back to the hot water cylinder; and a control circuit for controlling the amount of hot water that is in the hot water cylinder, the control circuit comprising:

a first sensor operable to measure the temperature of hot water being delivered into the hot water cylinder;

a second sensor operable to measure a characteristic of the water being delivered into the hot water cylinder for use in the determination of the amount of hot water being delivered into the hot water cylinder; and a programmable controller in communication with the first and second sensors, the programmable controller having: a processor for processing the data received from the first and second sensors; an accessible memory for storage of a domestic hot water profile; and means to operate the pump in accordance with the domestic hot water profile;

in which the second sensor is a flow sensor; and in which the first sensor and the second sensor are housed in a single unit; and in which the flow sensor is mounted in a return pipe connecting the outlet of the external heating circuit and an inlet of the hot water cylinder; and in which the external heating circuit comprises an electrical heater, the electrical heater comprising a casing housing an electrical element, an inlet formed in the casing fed from the hot water cylinder through which water to be heated is delivered to the interior of the casing adjacent the electrical element and an outlet formed in the casing through which heated water that has been heated by the electrical element is returned to the hot water cylinder.

* * * * *